US009133786B2

(12) United States Patent
Dölker

(10) Patent No.: US 9,133,786 B2
(45) Date of Patent: Sep. 15, 2015

(54) CONTROL AND REGULATION METHOD FOR AN INTERNAL COMBUSTION ENGINE HAVING A COMMON RAIL SYSTEM

(75) Inventor: Armin Dölker, Friedrichshafen (DE)

(73) Assignee: MTU FRIEDRICHSHAFEN GMBH, Friedrichshafen (DE)

( * ) Notice: Subject to any disclaimer, the term of this patent is extended or adjusted under 35 U.S.C. 154(b) by 869 days.

(21) Appl. No.: 13/130,824

(22) PCT Filed: Nov. 9, 2009

(86) PCT No.: PCT/EP2009/007988
§ 371 (c)(1),
(2), (4) Date: May 24, 2011

(87) PCT Pub. No.: WO2010/057587
PCT Pub. Date: May 27, 2010

(65) Prior Publication Data

US 2011/0231080 A1 Sep. 22, 2011

(30) Foreign Application Priority Data

Nov. 24, 2008 (DE) ..... 10 2008 058 721

(51) Int. Cl.
*F02D 41/38* (2006.01)
*F02D 41/12* (2006.01)
*F02D 41/14* (2006.01)

(52) U.S. Cl.
CPC ..... *F02D 41/3845* (2013.01); *F02D 41/3863* (2013.01); *F02D 41/123* (2013.01); *F02D 41/1479* (2013.01); *F02D 2041/141* (2013.01); *F02D 2250/04* (2013.01)

(58) Field of Classification Search
CPC ..... F02D 41/3845; F02D 41/1479; F02D 41/3863; F02D 41/123; F02D 2250/04; F02D 2041/141; F02D 2041/14; F02D 2250/31; F02M 59/36; F02M 59/366; F02M 63/023
USPC ..... 701/103
See application file for complete search history.

(56) References Cited

U.S. PATENT DOCUMENTS 6,279,532 B1 8/2001 Takano et al.
7,010,415 B2 * 3/2006 Dolker ..... 701/107

(Continued)

FOREIGN PATENT DOCUMENTS

CN 1788154 A 6/2010
DE 10330466 B3 10/2004

(Continued)

*Primary Examiner* — Stephen K Cronin
*Assistant Examiner* — Sherman Manley
(74) *Attorney, Agent, or Firm* — Lucas & Mercanti, LLP; Klaus P. Stoffel

(57) ABSTRACT

The invention relates to a control and regulation method for an internal combustion engine (1) having a common rail system wherein the rail pressure (pCR) is regulated in normal operation in that an offset of the rail pressure (pCR) is calculated and a PWM signal (PWM) is determined for activating the control process via a pressure controller based on the offset, wherein a load rejection when the rail pressure (pCR) exceeds a limit and wherein upon recognition of the load rejection, the rail pressure (pCR) is controlled in that the PWM signal (PWM) is temporarily set to a PWM value that is higher compared to normal operation via a PWM parameter. The invention is characterized in that the threshold for activation of the temporary PWM parameter is calculated in dependence on the gradient of a power-determining signal.

5 Claims, 5 Drawing Sheets

(56) References Cited

U.S. PATENT DOCUMENTS

| | | | | |
|---|---|---|---|---|
| 7,182,064 | B2 * | 2/2007 | Dolker et al. | 123/352 |
| 7,270,115 | B2 * | 9/2007 | Dolker | 123/467 |
| 7,451,038 | B2 * | 11/2008 | Kosiedowski et al. | 701/103 |
| 7,461,634 | B2 | 12/2008 | Watanabe et al. | |
| 7,610,901 | B2 | 11/2009 | Bucher et al. | |
| 7,779,816 | B2 * | 8/2010 | Dolker | 123/456 |
| 8,100,096 | B2 * | 1/2012 | Dolker | 123/41.08 |
| 2009/0151659 | A1 * | 6/2009 | Dolker | 123/41.09 |
| 2009/0223488 | A1 * | 9/2009 | Dolker | 123/456 |

FOREIGN PATENT DOCUMENTS

| | | | |
|---|---|---|---|
| DE | 102005029138 | B3 | 12/2006 |
| DE | 102006040441 | B3 | 2/2008 |
| DE | 102006049266 | B3 | 3/2008 |
| EP | 0892168 | B1 | 6/2006 |
| WO | 2005111402 | A1 | 11/2005 |
| WO | WO 2006136414 | A1 * | 12/2006 |

* cited by examiner

CONTROL AND REGULATION METHOD FOR AN INTERNAL COMBUSTION ENGINE HAVING A COMMON RAIL SYSTEM

The present application is a 371 of International application PCT/EP2009/007988 filed Nov. 9, 2009, which claims priority of DE 10 2008 058 721.4, filed Nov. 24, 2008, the priority of these applications is hereby claimed and these applications are incorporated herein by reference.

BACKGROUND OF THE INVENTION

The invention concerns a method for the open-loop and closed-loop control of an internal combustion engine with a common rail system, in which, during normal operation, the rail pressure is controlled by closed-loop control, and, when a load reduction is detected, a change is made from closed-loop control to open-loop control, wherein, during the open-loop control operation, the PWM signal is temporarily set to a PWM value that is higher than in normal operation in order to load the controlled system.

In a common rail system, a high-pressure pump delivers the fuel from a fuel tank to a rail. The admission cross section to the high-pressure pump is determined by a variable suction throttle. Injectors are connected to the rail. They inject the fuel into the combustion chambers of the internal combustion engine. Since the quality of the combustion is decisively determined by the pressure level in the rail, this pressure is automatically controlled. The closed-loop high-pressure control system comprises a pressure controller, the suction throttle with the high-pressure pump, the rail as the controlled system, and a filter in the feedback path. In this closed-loop high-pressure control system, the controlled variable is the pressure level in the rail. The measured pressure values in the rail are converted by the filter to an actual rail pressure and compared with a set rail pressure. The control deviation obtained by this comparison is then converted to a control signal for the suction throttle by the pressure controller. The control signal corresponds, e.g., to a volume flow in the unit of liters/minute. The control signal is electrically generated as a PWM signal of constant frequency, for example, 50 Hz. The closed-loop high-pressure control system described above is disclosed by DE 103 30 466 B3.

Due to the high dynamic response, a load reduction is an event that is difficult to control from the standpoint of automatic control engineering, since after a load reduction, the rail pressure can rise with a pressure gradient of up to 4000 bars/second. A passive pressure control valve that opens at a rail pressure of 1950 bars protects the common rail system from an impermissibly high rail pressure. If, for example, an internal combustion engine is being operated in a steady state at a constant rail pressure of 1800 bars, and a complete load rejection occurs, the time until the pressure control valve responds is 37.5 ms.

To improve the reliability of the closed-loop pressure control, DE 10 2005 029 138 B3 proposes that after a load reduction has been detected, the control operation be changed from closed-loop control to open-loop control. In the open-loop control operation, the PWM signal for activating the suction throttle is temporarily set to an increased PWM value by a step function, which accelerates the closing process of the suction throttle, and less fuel is delivered to the rail. After expiration of the timed step function, the operation reverts to closed-loop control. A load reduction is detected by virtue of the fact that the actual rail pressure exceeds a fixed limit. The method just described has proven effective for a complete load rejection, i.e., a reduction of the generator load from 100% to 0%.

In practice, however, it was found that the method is still not optimal in the case of a partial load reduction. A partial load reduction occurs when only some individual electrical consumers are deactivated. Under unfavorable conditions, pressure oscillations in the rail can arise, which are caused by several successive changes from closed-loop control to open-loop control with temporary PWM assignment.

SUMMARY OF THE INVENTION

Proceeding from the temporary PWM assignment described in DE 10 2005 029 138 B3, the objective of the present invention is to optimize the closed-loop pressure control when a partial load reduction occurs.

The optimization consists in computing the limiting value for activation of the temporary PWM assignment as a function of the gradient of a power-determining signal. In this regard, the power-determining signal corresponds to a set speed, a set torque, or a set injection quantity. The set speed can also correspond to an accelerator pedal position. The gradient of, for example, the set torque is used as a measure of the magnitude of the load reduction. The faster this decreases, the greater the amount of load that has been rejected. Accordingly, the basis of the invention is the recognition that during a load reduction, first the power-determining signal drops, and then the rail pressure rises but only with a certain amount of time delay. The limiting value is determined by its own characteristic curve, which is realized in such a form that when there is a complete load rejection, a lower limiting value is set, whereas when there is a partial load rejection, a higher limiting value is set.

The method of the invention is intended to supplement the method disclosed in DE 10 2005 029 138 B3. An advantage of the invention is that the cause of the oscillations of the rail pressure in a partial load reduction is eliminated. The rail pressure thus shows more uniform behavior. Both in the ease of a complete load rejection and in the case of a partial load rejection, unintended opening of the passive pressure control valve is prevented, and at the same time stable rail pressure is realized. As a pure software solution (i.e., additional sensors or changes in the electronic engine control unit are unnecessary), the realization of the invention is practically cost-neutral.

A preferred embodiment of the invention is illustrated in the figures.

DETAILED DESCRIPTION OF THE INVENTION

Figure 1:
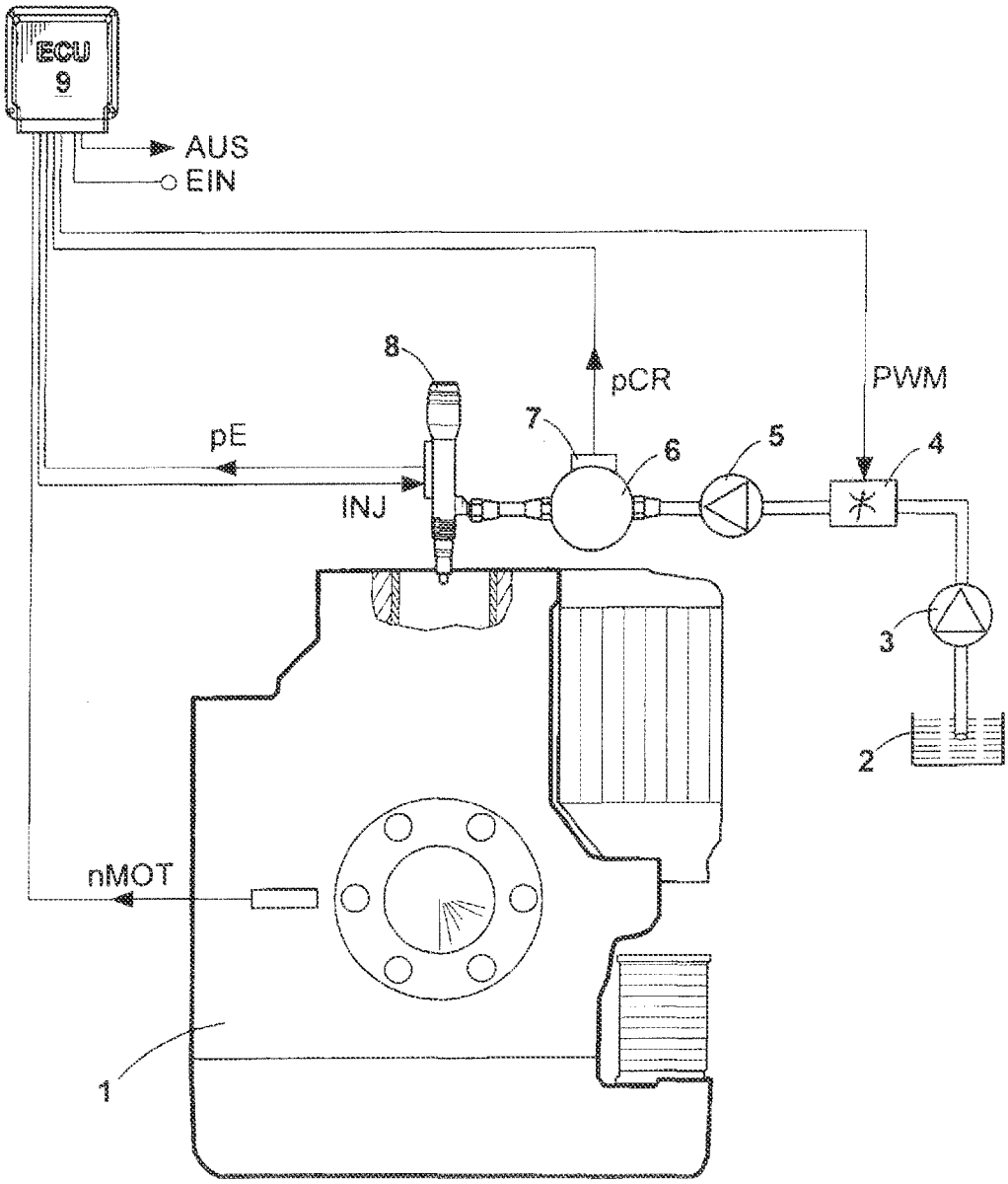
FIG. 1 is a system diagram.

FIG. 1 shows a block diagram of an electronically controlled internal combustion engine 1 with a common rail system. The internal combustion engine 1 powers an emergency power generating unit (not shown). The common rail system comprises the following mechanical components: a low-pressure pump 3 for delivering fuel from a fuel tank 2, a suction throttle 4 for controlling the volume flow, a high-pressure pump 5, a rail 6, and injectors 8 for injecting fuel into the combustion chambers of the internal combustion engine 1.

The internal combustion engine 1 is controlled by an electronic engine control unit 9 (ECU). Input variables of the electronic engine control unit 9 shown in FIG. 1 are the rail pressure pCR, which is detected by a pressure sensor 7, the engine speed nMOT, and a variable EIN. The variable EIN is representative of other input signals, for example, input signals for the oil temperature or fuel temperature. The output variables of the electronic engine control unit 9 shown in FIG. 1 are a PWM-signal PWM for activating the suction throttle 4, an injection signal INJ for activating the injectors 8, and a variable AUS. The signal INJ that characterizes the injection stands for an injection start, an injection duration, and an injection end. The variable AUS represents additional control signals for controlling the internal combustion engine 1, for example, a control signal for activating an AGR valve. Naturally, the common rail system illustrated here can also be realized as a common rail system with individual accumulators. In this case, the individual accumulator is integrated in the injector, and then the individual accumulator pressure pE is an additional input signal of the electronic engine control unit 9.

Figure 2:
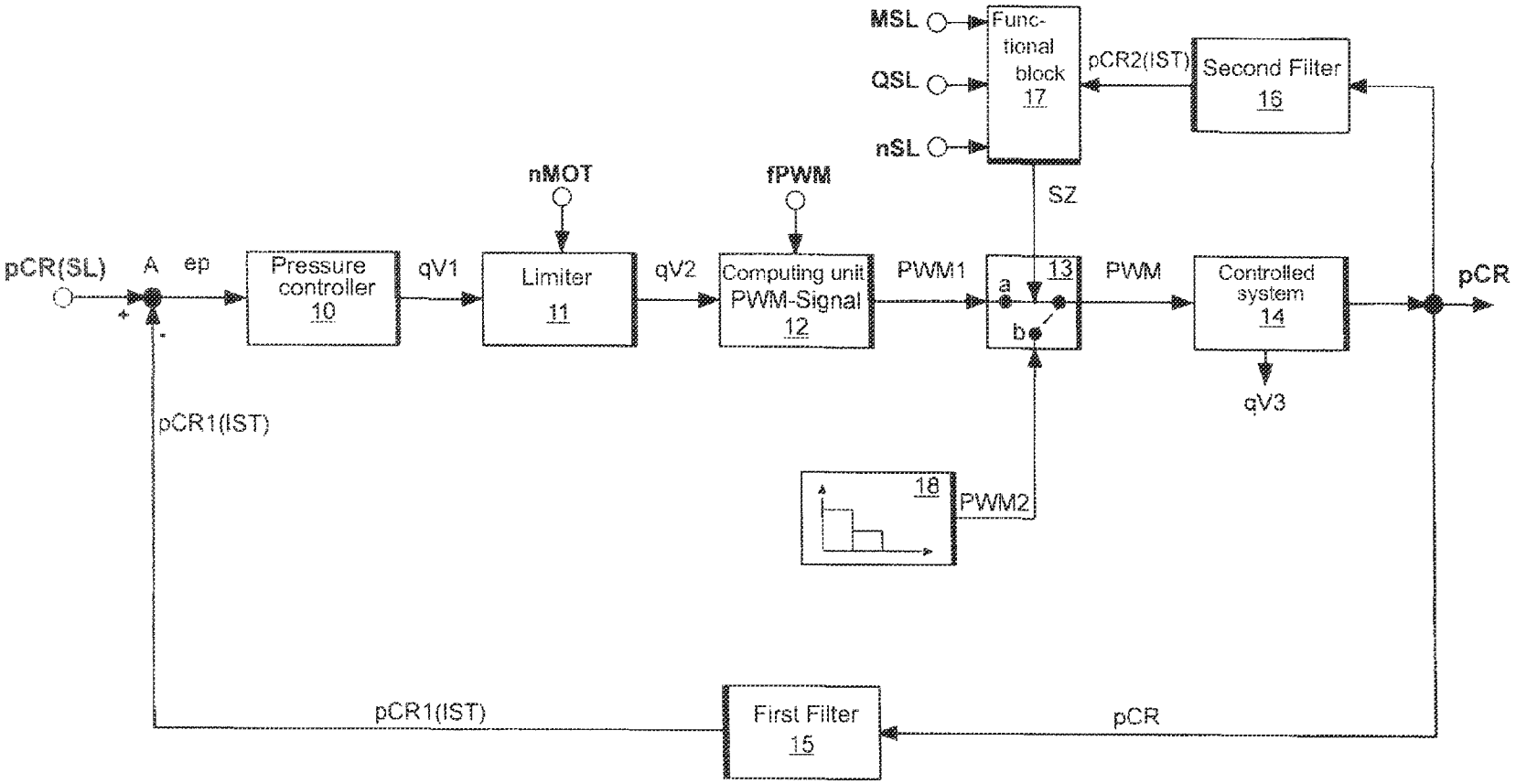
FIG. 2 is a block diagram of a closed-loop high-pressure control system.

FIG. 2 is a block diagram of the closed-loop high-pressure control system for automatically controlling the rail pressure. The input variable of the closed-loop control system is a set rail pressure pCR(SL). The output variable corresponds to the raw value of the rail pressure pCR. A first actual rail pressure pCR1(IST) is determined from the raw value of the rail pressure pCR by means of a first filter 15. This value is compared with the set rail pressure pCR(SL) at a summation point A, and a control deviation ep is obtained from this comparison. A correcting variable is calculated from the control deviation ep by means of a pressure controller 10. The correcting variable represents a volume flow qV1, whose physical unit is liters/minute. In an optional provision, the calculated set consumption is added to the volume flow qV1. The volume flow qV1 is then limited by a limiter 11, which can be made speed-dependent by using nMOT as an input variable. The output variable qV2 of the limiter 11 is a volume flow qV2. If the value of the volume flow qV1 is in the permissible range, then the value of the volume flow qV2 is equal to the value of the volume flow qV1. The volume flow qV2 is then converted to a PWM-signal PWM1 by a computing unit 12. In this regard, the PWM-signal PWM1 represents the duty cycle, and the frequency fPWM corresponds to the base frequency, for example 50 Hz. Fluctuations in the operating voltage and the fuel admission pressure are also taken into consideration in the conversion. The PWM-signal PWM1 is the first input variable of a switch 13. The second input variable of the switch 13 is a PWM-signal PWM2. The switch 13 is activated by a functional block 17 by means of a control signal SZ. Depending on the position of the switch 13, the output signal PWM of the switch 13 corresponds either to the signal PWM1 or to the signal PWM2. The solenoid coil of the suction throttle is then acted upon by the PWM-signal PWM. This changes the displacement of the magnetic core, and the output of the high-pressure pump is freely controlled in this way. The high-pressure pump, the suction throttle, and the rail represent a controlled system 14. A consumption volume flow qV3 is removed from the rail 6 through the injectors. The closed-loop control system is thus closed.

Figure 3:
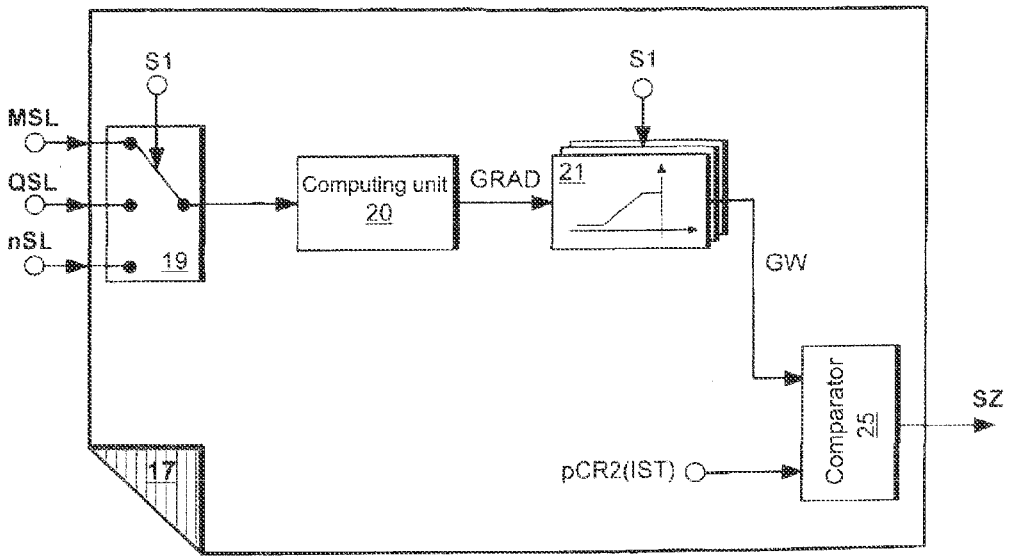
FIG. 3 is a block diagram for determining a triggering signal.

This closed-loop control system is supplemented by the temporary PWM assignment unit, which comprises a second filter 16 for computing a second actual rail pressure pCR2 (IST) and the functional block 17 for determining the control signal SZ. The second filter 16 has a significantly smaller time constant than the first filter 15. The functional block 17 is shown in FIG. 3 and will be explained in connection with FIG. 3. The input variables of functional block 17 are a set torque MSL or a set injection quantity QSL or the set speed nSL. Therefore, the power-determining signal corresponds either to the set torque MSL or the set injection quantity QSL or the set speed nSL. Instead of the set speed nSL, it is also possible to use an accelerator pedal position. During closed-loop control operation, the switch 13 is in position a. In position a, the PWM signal for acting on the controlled system 14 is determined by the pressure controller 10. If the second actual rail pressure pCR2(IST) exceeds a limit, the functional block 17 changes the signal level of the control signal SZ, which causes the switch 13 to change over to position b. In position b, a PWM value PWM2, which is increased compared to normal operation, is temporarily output by the PWM assignment unit 18. In other words, the operation is changed from closed-loop control to open-loop control. The temporary PWM assignment can be realized, as illustrated, in step form with a first and a second time stage of, for example, 10 ms each. After the expiration of this length of time, the switch 13 then changes back to position a, so that closed-loop control is reestablished.

Figure 4:
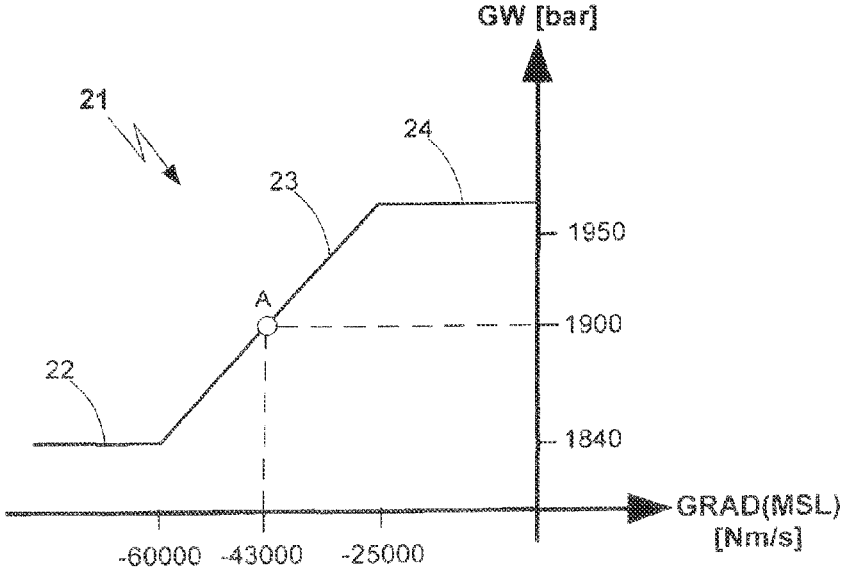
FIG. 4 is a characteristic curve for determining the limiting value.

FIG. 3 shows the functional block 17 for determining the control signal SZ, by which the position of the switch 13 is determined. The input variables are the set torque MSL, the set injection quantity QSL, and the set speed nSL. The output variable is the control signal SZ. A signal S1 determines which of the three input signals is used for determining the limiting value (selector 19). Signal S1 also serves to determine which of the three characteristic curves 21 is activated. The further description of FIG. 3 is based on the example of the set torque MSL. A computing unit 20 serves to determine the gradient GRAD of the set torque MSL, and a limiting value GW is assigned to the gradient GRAD by the characteristic curve 21. The characteristic curve 21 is shown in FIG. 4 and will be explained in connection with FIG. 4. The limiting value GW and the second actual rail pressure pCR2(IST) are compared with each other by a comparator 25. If the second actual rail pressure pCR2(IST) exceeds the limiting value GW, then the control signal SZ is set, which causes the switch 13 to change to position b. In position b, the temporary PWM assignment, i.e., open-loop control, is activated.

FIG. 4 shows one of the three characteristic curves 21, in this case for the set torque as the input variable. The gradient GRAD in Nm/s is plotted on the x-axis. The limiting value in bars is plotted on the y-axis. The characteristic curve 21 consists of a first linear segment 22 parallel to the x-axis, a second linear segment 23 with positive slope, and a third linear segment 24 parallel to the x-axis. The basic idea of the invention is to create a variable limiting value GW via the characteristic curve 21. If, in a load reduction, a large load is rejected, the result is a very high negative gradient GRAD (GRAD<−60,000 Nm/s) of the set torque MSL. Therefore, a limiting value that is only slightly above the maximum steady-state rail pressure of 1800 bars, here 1840 bars, is computed by the first gradient segment 22. This prevents the temporary PWM increase from being activated too late, and the passive pressure control valve responds at a rail pressure of 1950 bars. If, on the other hand, a small to intermediate load is rejected in a load reduction, the result is a small negative gradient GRAD (0>GRAD>−25,000 Nm/s) of the set torque MSL. Therefore, a limiting value of GW=1970 bars is computed by the third linear segment 24, so that a triggering of the temporary PWM increase remains without effect. If an intermediate load is rejected, the result is an intermediate gradient GRAD (−60,000<GRAD<−25,000 Nm/s), to which a corresponding limiting value is assigned by the second linear segment 23. For example, a limiting value of GW=1900 bars is assigned to a gradient GRAD=−43,000 Nm/s via the operating point A on the second linear segment 23.

Figure 5A:
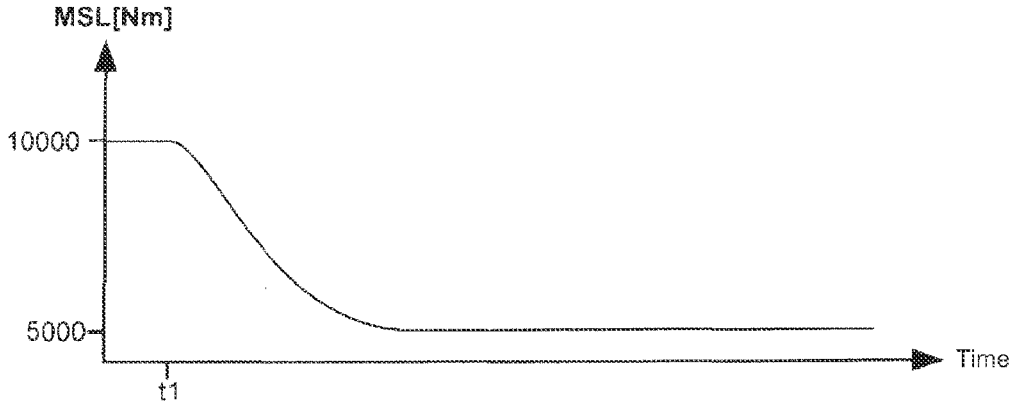
FIG. 5 shows a load reduction in the form of a time-dependency diagram.
Figure 5B:
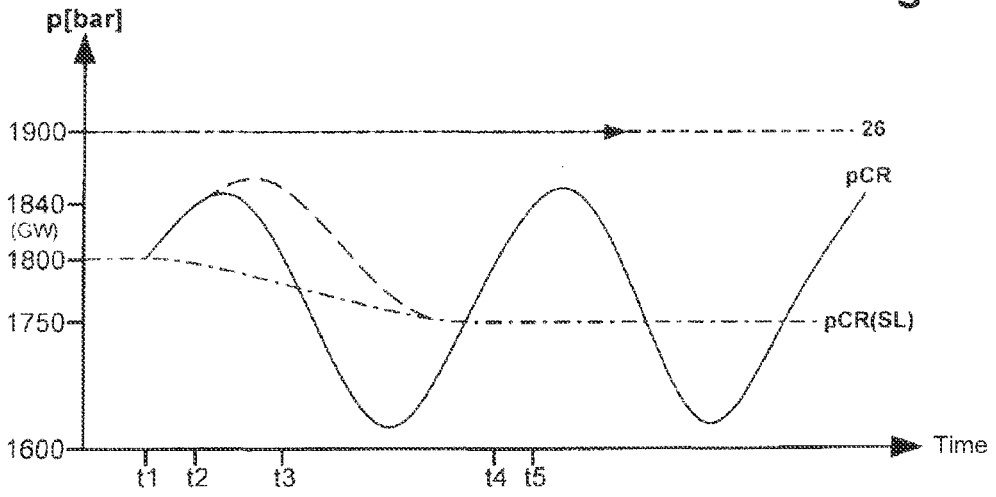
Figure 5C:
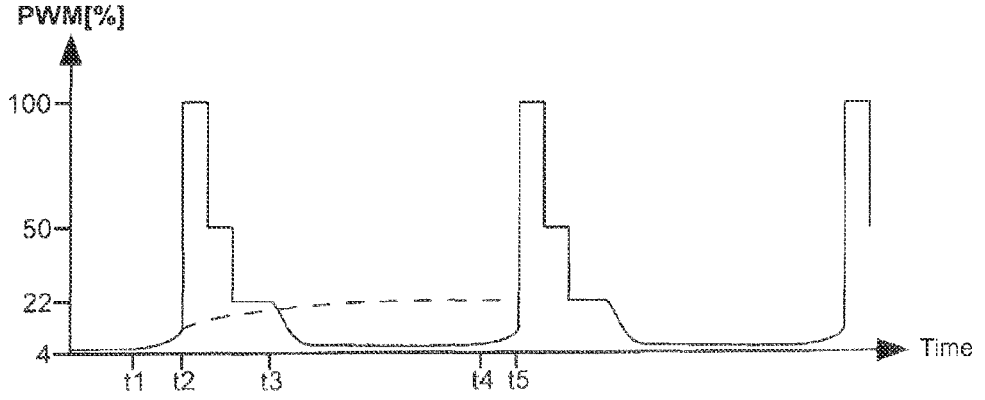

FIG. 5 shows a load reduction in the form of a time-dependency diagram. FIG. 5 comprises three graphs 5A to 5C. FIG. 5A shows the behavior of the set torque MSL over time. FIG. 5B shows the behavior of the set rail pressure pCR(SL) as a dot-dash line and the behavior of the rail pressure pCR (raw values) over time. FIG. 5C shows the behavior of the PWM-signal PWM over time. In FIG. 5B and FIG. 5C, the solid line describes behavior according to the prior art, while the broken line describes behavior in accordance with the invention. Further discussion is based on a load reduction from 100% load to 50% load.

The course of the method according to the prior art is as follows:

The set torque MSL is reduced after time t1 from 10,000 Nm/s to 5,000 Nm/s. Since the set rail pressure pCR(SL) is computed by an input-output map as a function of the set torque MSL and the actual speed, the set rail pressure pCR (SL) falls from 1800 bars to 1750 bars after time t1 (FIG. 5B). The rail pressure pCR rises after the load rejection. Due to the increasing, negative control deviation (FIG. 2, ep), the pressure controller computes an increasing PWM signal in the time interval t1/t2 in FIG. 5C. The increasing PWM-signal PWM causes activation of the suction throttle in the closing direction. At time t2 the rail pressure pCR exceeds the fixed limit of GW=1840 bars, which causes a change from closed-loop control to open-loop control. In open-loop control operation, the temporary PWM increase is activated by virtue of the fact that the PWM signal in the course of two time stages is increased first to 100% duty cycle and then to 50% duty cycle. As a result of the temporary PWM increase, the rail pressure pCR falls again, namely, to about 1650 bars. Therefore, the control deviation rises to about 100 bars. If the rail pressure pCR falls below the set rail pressure pCR(SL), the time stages of the temporary PWM increase have already expired, so that closed-loop control is reactivated. Due to the resulting positive control deviation, the PWM duty cycle falls to a minimum value of 4% after time t3. The suction throttle is now completely open again, so that the rail pressure pCR rises sharply. Since the set rail pressure pCR(SL) at 50% load is only 50 bars below the set rail pressure at 100% load, the rail pressure pCR, when it overshoots (time interval t4/t5), again reaches the limiting value GW at 1840 bars. Therefore, the operation changes back to open-loop control at time t5, and the temporary TWM increase is activated. As a consequence, the rail pressure pCR drops again. As is clearly apparent from FIG. 5B on the basis of the rail pressure pCR (solid line), the repeated activation of the temporary PWM increase causes corresponding pressure oscillations of the rail pressure pCR.

The course of the method according to the invention is as follows:

The gradient GRAD is computed from the course of the set torque MSL. The characteristic curve 21 is used to assign a limit to the computed gradient GRAD (in this example, a limit of 1900 bars). This limit is drawn in FIG. 5B as line 26 parallel to the time axis. The rail pressure pCR remains below this limit, so that the temporary PWM increase is not activated. Therefore, closed-loop control is maintained. Due to the initially increasing control deviation, a maximum PWM value of 22% is output, i.e., the suction throttle is completely closed. As is shown in FIG. 5B, the rail pressure pCR (broken line) approaches the set rail pressure pCR(SL) this time without oscillations.

Figure 6:
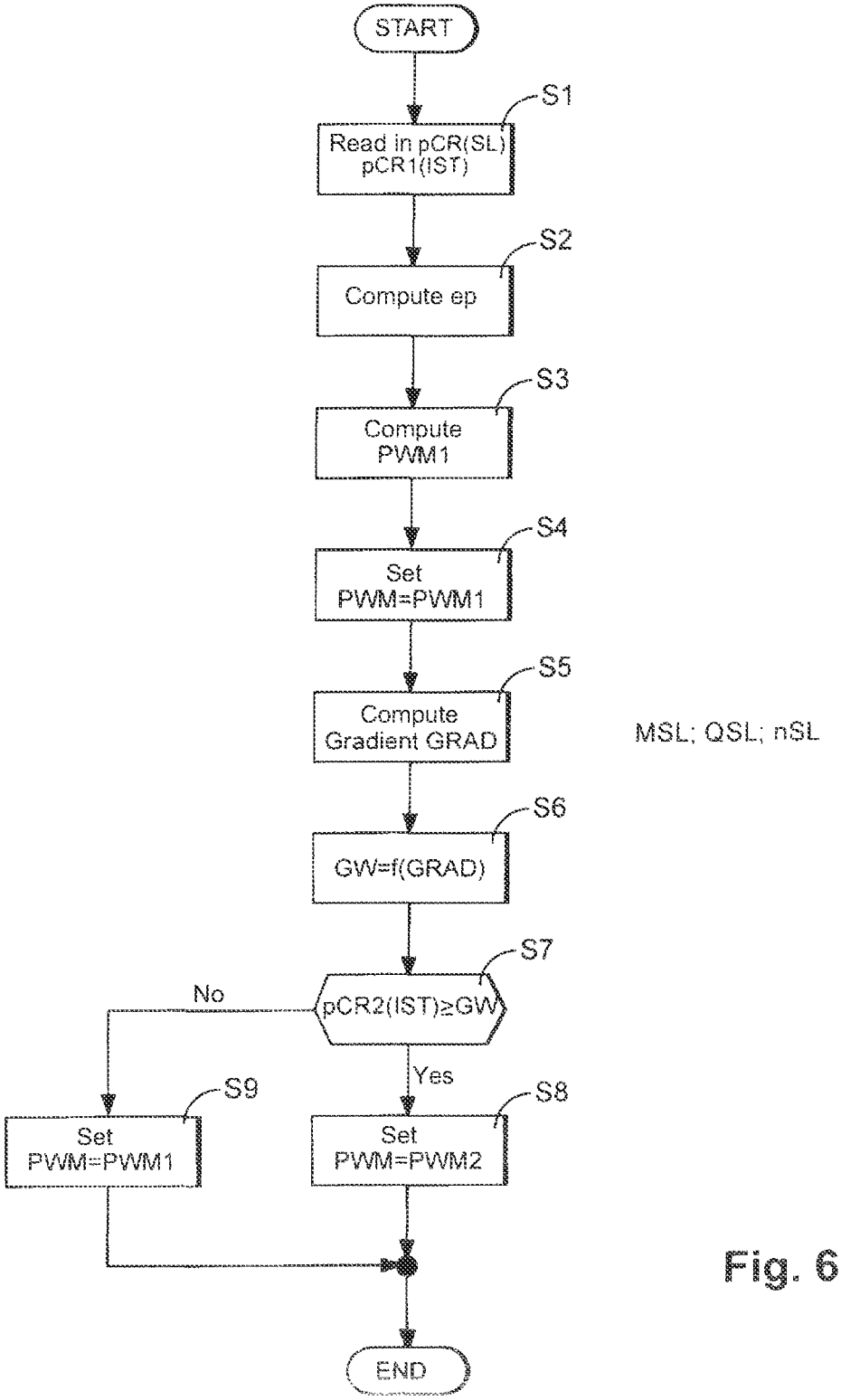
FIG. 6 is a program flowchart.

FIG. 6 shows a reduced program flowchart of the method. At the beginning of the method, closed-loop control is activated. At S1 the set rail pressure pCR(SL) and the first actual rail pressure pCR(IST) are read in, and at S2 the control deviation ep is computed. Using the control deviation ep, the pressure controller computes its correcting variable, which is converted to the PWM-signal PWM1 at S3. This signal then acts on the controlled system, since the switch (FIG. 2: 13) is in position a. We than have PWM=PWM1, S4. At S5 the gradient GRAD of the power-determining signal is computed. The power-determining signal corresponds to the set torque MSL, the set injection quantity QSL, or the set speed nSL. The set torque MSL and the set injection quantity QSL correspond to the correcting variable of a closed-loop speed control system. At S6 a variable limit GW is then determined by the selected characteristic curve (FIG. 4: 21). At S7 a check is made to determine whether the second actual rail pressure pCR2(IST) is greater than or equal to the second actual rail pressure pCR2(IST). If this is not the case (interrogation result S7: no), then at S9 closed-loop control remains activated, and the PWM signal continues to correspond to the value PWM1. The program flow then ends. If, on the other hand, it was determined at S7 that the second actual rail pressure pCR2(IST) is greater than or equal to the limit GW (interrogation result S7: yes), then at S8 a change is made to open-loop control, and the temporary PWM increase is activated, during which the PWM-signal PWM corresponds to the signal PWM2. The program flow then ends.

LIST OF REFERENCE NUMBERS

1 internal combustion engine
2 tank
3 low-pressure pump
4 suction throttle
5 high-pressure pump
6 rail
7 pressure sensor (rail)
8 injector
9 electronic engine control unit (ECU)
10 pressure controller
11 limiter
12 computing unit PWM signal
13 switch
14 controlled system
15 first filter
16 second filter
17 functional block
18 PWM assignment unit
19 selector
20 computing unit
21 characteristic curve
22 first linear segment
23 second linear segment
24 third linear segment
25 comparator
26 limit

The invention claimed is:

1. A method for open-loop and closed-loop control of an internal combustion engine with a common rail system, comprising the steps of: controlling rail pressure (pCR) during normal operation by closed-loop control by computing a control deviation (ep) of the rail pressure (pCR) and determining a PWM-signal (PWM) for controlling a controlled system by a pressure controller based on the control deviation (ep); recognizing a load reduction when the rail pressure (pCR) exceeds a limit (GW) and switching from closed-loop control to open loop control; subjecting the rail pressure (pCR), when a load reduction is detected, to open-loop control by temporarily setting the PWM-signal (PWM) to a PWM value (PWM2) that is increased compared to normal operation by a PWM assignment unit or maintains closed-loop control when the rail pressure (pCR) remains below the limit (GW); and computing the limit (GW) for activation of the temporary PWM assignment as a function of the gradient (GRAD) of a power-determining signal over a characteristic curve, wherein the characteristic curve is configured so that with a complete load reduction a lower limit (GW) is set and with a partial load reduction higher limit (GW) is set.

2. The method in accordance with claim 1, including determining the limit (GW) by a characteristic curve that can be selected from a set of characteristic curves.

3. The method in accordance with claim 2, wherein the power-determining signal corresponds to a set torque (MSL), a set injection quantity (QSL), or a set speed (nSL).

4. The method in accordance with claim 3, including determining the set torque (MSL) or the set injection quantity (QSL) as a correcting variable in a closed-loop speed control system.

5. The method in accordance with claim 3, wherein the set speed (nSL) corresponds to an accelerator pedal position.

* * * * *